United States Patent [19]

Matsuda et al.

[11] 4,278,442

[45] Jul. 14, 1981

[54] METHOD FOR REDUCING CAKING PROPERTY OF COAL

[76] Inventors: Minoru Matsuda, 1-11-806, Kawauchi-Jutaku, Kawauchi Mubanchi, Sendai, Miyagi; Hirotsugu Iwasaki, 11-5, Kinoshita, 2 Chome, Sendai, Miyagi; Yasukatsu Tamai, 1-11-401, Kawauchi-Jutaku, Kawauchi Mubanchi, Sendai Miyagi; Masashi Iino, 2-5, Kunimi 2 Chome, Sendai Miyagi; Hiroshi Fukutome, 413, Kitamemachi Bldg., 2, Kitamemechi 4 Chome, Sendai, Miyagi, all of Japan

[21] Appl. No.: 98,448

[22] Filed: Nov. 29, 1979

[30] Foreign Application Priority Data

Nov. 30, 1978 [JP] Japan ..... 53-148132

[51] Int. Cl.[3] ..... C10L 5/00

[52] U.S. Cl. ..... 44/1 R

[58] Field of Search ..... 44/1 R, 1 SR; 201/17

[56] References Cited

U.S. PATENT DOCUMENTS

| | | | |
|---|---|---|---|
| 2,336,154 | 12/1943 | Wolf | 202/20 |
| 2,739,105 | 3/1956 | Ford et al. | 201/17 |
| 3,536,589 | 10/1970 | Voet et al. | 201/9 |
| 3,870,237 | 3/1975 | Aldrich | 241/1 |
| 3,998,604 | 12/1976 | Hinkley | 44/1 R |
| 4,018,654 | 4/1977 | Johnson et al. | 201/9 |
| 4,120,664 | 10/1978 | Gleim | 44/1 SR |
| 4,169,710 | 10/1979 | Jensen | 44/1 SR |
| 4,198,291 | 4/1980 | Yoo et al. | 44/1 SR |

*Primary Examiner*—Carl F. Dees

*Attorney, Agent, or Firm*—Blanchard, Flynn, Thiel, Boutell & Tanis

[57] ABSTRACT

A method for reducing the caking property of coal, by contacting coal with sulfur dioxide in an amount at least 0.5 times the amount of the coal on a weight basis, at a temperature of at least 120° C. under a pressure of at least 10 Kg/cm$^2$, and separating the treated coal from the sulfur dioxide, whereby to reduce the caking property of the coal and to render the coal more easily pulverizable.

7 Claims, 5 Drawing Figures

FIG. 2-(1)
0.1 mm
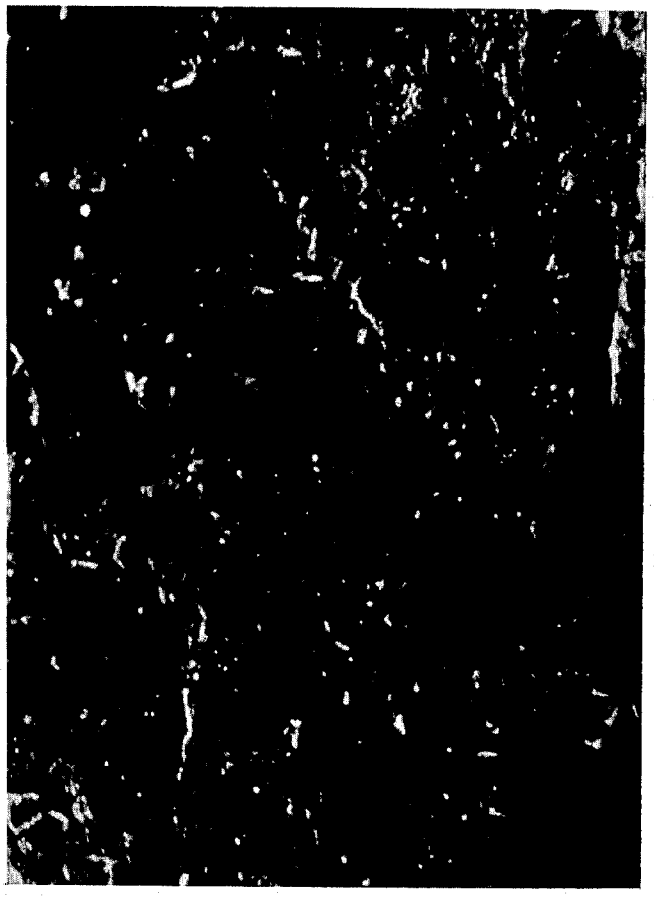

FIG. 2-(2)
0.1 mm
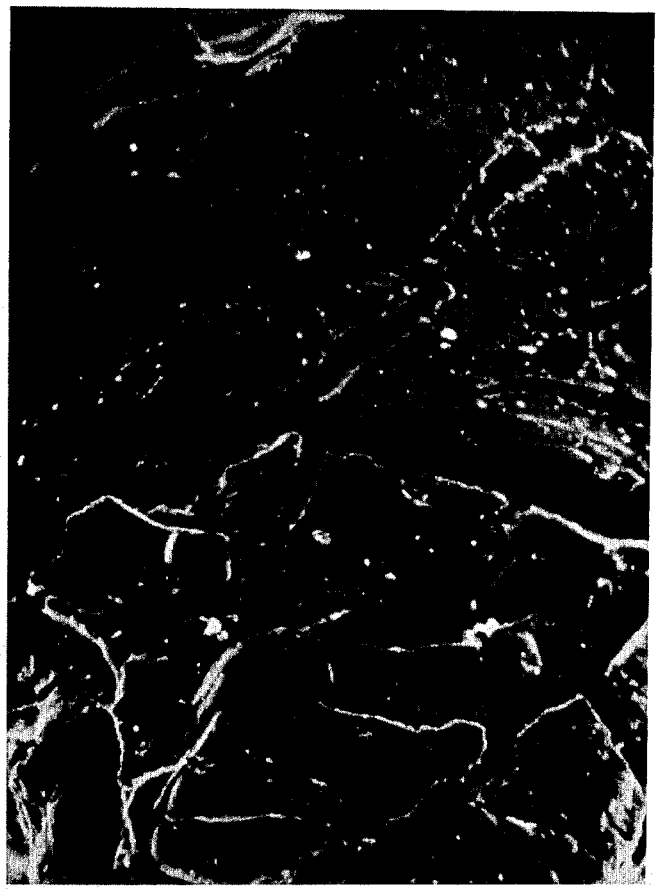

METHOD FOR REDUCING CAKING PROPERTY OF COAL

The present invention relates to a method for obtaining treated coal having a reduced caking property and an improved pulverizability by reacting coal with sulfur dioxide under high temperature and high pressure conditions.

Techniques of using coal as an energy source or as a starting material for preparing chemicals have been developed and established. For example, gasification of coal, liquefaction of coal and formation of colloidal fuels have been attempted and proposed. In each of these processes, the properties of the starting coal, especially the caking property and the particle size thereof, should be adjusted appropriately. In the so-called coal gasification process comprising contacting coal with at least one gasifying agent selected from steam, oxygen and hydrogen, at a high temperature, to obtain a valuable gas containing carbon monoxide, methane and the like, the main factors influencing the gasification ratio are the caking property, the particle size, the reactivity and the water content of the starting coal and the properties of the ash component. Moreover, as is well known, the operational difficulty in feeding coal into a gasifying furnace and the structure of the gasifying furnace are remarkably influenced by the caking property and the particle size of the coal. Also, in the liquefaction of coal by a high temperature treatment, the caking property and the particle size are important factors. Furthermore, in the production of colloidal fuels, the caking property and the particle size are important factors.

In most of the other industrial processes using coal, it is desired that the starting coal has a low caking property and an appropriate particle size.

The present invention provides a method for reducing the caking property of the starting coal and rendering the coal more easily pulverizable.

More specifically, in accordance with the present invention, there is provided a method for reducing the caking property of coal, by contacting coal with sulfur dioxide in an amount at least 0.5 times the amount of the coal, on a weight basis, at a temperature of at least 120° C., under a pressure of at least 10 Kg/cm$^2$, and separating the treated coal from the sulfur dioxide, whereby to reduce the caking property of the coal and to render the coal more easily pulverizable.

BRIEF DESCRIPTION OF THE DRAWINGS

FIG. 2-(1) is a scanning electron microscope photograph of the surface of Shin-Yubari coal's texture, and FIG. 2-(2) is a scanning electron microscope photograph of the surface of the coal's texture after treatment under the conditions identified at point 23 in FIGS. 1 and 3.

The present invention will now be described in detail.

The most important feature of the present invention is that the starting coal is contacted with a sufficient amount of sulfur dioxide, under high temperature and high pressure conditions, for a sufficient length of time.

As is well known, the caking property of coal differs remarkably depending on the kind of coal used and the place where the coal was mined. There are various methods for measuring and indicating the caking property of coal. In this specification, the button method, which is the most popular method and which is described in JIS M-8801, and the button indexes (CSN indexes) determined by this method, are used to identify the caking property of coal. CSN indexes such as 0.5, 1, 1.5, . . . 9 indicate the caking property of coal. A higher CSN index value indicates a higher caking property. For example, among the coals produced in Japan, Shin-Yubari coal has a high caking property corresponding to a CSN index of 8 and Akahira coal has a medium caking property corresponding to a CSN index of 4. Accordingly, there are many kinds of coals that differ significantly in their caking property. In industrial processes using coal, the degree of reduction of the caking property, that is, the reduction in the CSN index, is very important.

In the method of the present invention, from the industrial viewpoint and in view of the operation efficiency, it is preferred that the treatment conditions, such as the treatment temperature and pressure, the weight ratio of sulfur dioxide to the starting coal and the contact time be appropriately chosen depending on the CSN index of the starting coal and the desired CSN index of the treated coal. The method of the present invention was completed based on the results of experiments made on various coals produced in Japan and foreign countries. In the method of the present invention, it is intended to reduce the CSN index of the treated coal, preferably to a level lower than 1.5.

The present invention will now be described by reference to Shin-Yubari coal as an example of coal having a high caking property and Akahira coal as an example of coal having a medium caking property. The elementary analysis values (%) of both the starting coals and the CSN indexes thereof are shown in Table 1.

TABLE 1

| | Akahira Coal | Shin-Yubari Coal |
|---|---|---|
| C (wt. %) | 82.3 | 86.1 |
| H (wt. %) | 5.9 | 6.1 |
| N (wt. %) | 2.3 | 2.0 |
| S (wt. %) | 0.3 | 0.3 |
| O (wt. %) | 9.2 | 5.5 |
| CSN index | 4 | 8 |

Figure 1:
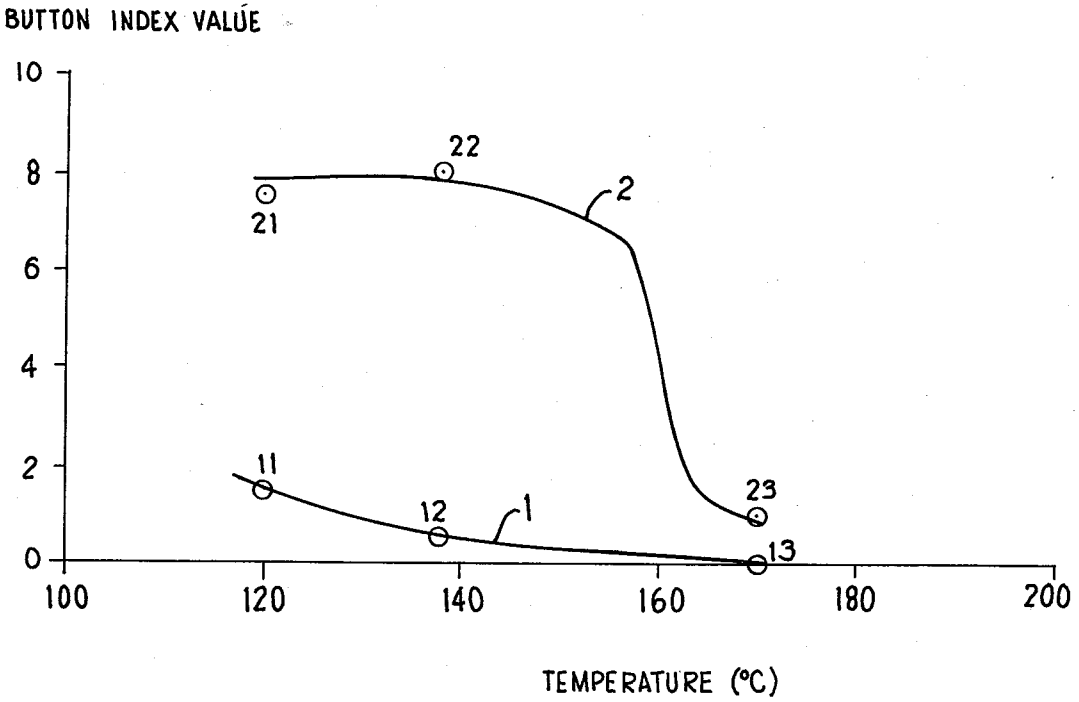
FIG. 1 is a graph of experimental results showing the relation between the treatment temperature in the method of the present invention and the button index of the treated coal.

The relation between the treatment temperature in the method of the present invention and the CSN index (button index) of the treated coal are illustrated in FIG. 1. More specifically, starting coal having a particle size of 9–16 mesh and sulfur dioxide, used in an amount 9 times by weight the weight of the starting coal, are mixed and contacted with each other in a sealed vessel for 3 hours. The relation between the treatment temperature and the CSN index, under these conditions, is illustrated in FIG. 1. Curve 1 shows results obtained in the treatment of Akahira coal and curve 2 shows results obtained in the treatment of Shin-Yubari coal. From FIG. 1, it is seen that the CSN index can be reduced to a level below 1.5 when the treatment is carried out at about 120° C. or higher in the case of a coal having a medium caking property corresponding to a CSN index of 4 and at about 164° C. in the case of a coal having a high caking property corresponding to a CSN index of 8. Of course, if the treatment temperature is further elevated, the CSN index can be further reduced. In other words, the treatment temperature is changed according to the desired CSN index of the final treated coal product.

The treatment temperature also influences the pulverizability of the coal.

The particle size (mesh) of the coal, after being treated under temperature conditions indicated at points 11, 12 and 13 of curve 1 of FIG. 1 and at points 21, 22 and 23 of curve 2 of FIG. 1, are set forth in Table 2. It is seen that a significant amount of the coal particles initially having a size of 9–16 mesh undergo particle size reduction by the treatment. For the same treatment temperature and pressure conditions, a starting coal initially having a higher caking property undergoes a greater particle size reduction than a coal initially having a lower caking property. In case of the same starting coal, a higher treatment temperature and a higher treatment pressure provide a greater particle size reduction effect.

TABLE 2

| Coal | Temperature (°C.) | Pressure (Kg/cm$^2$) | Size (mesh) of Starting Coal | Particle Size Distribution (%) of Treated Coal Particle Size (mesh) 9–16 | 16–32 | 32–60 | 60–100 | 100–200 | 200– |
|---|---|---|---|---|---|---|---|---|---|
| Akahira | — | — | 9–16 | — | — | — | — | — | — |
| Akahira | 120 | 43 | 9–16 | 82.2 | 11.0 | 4.3 | 1.4 | 0.9 | 0.3 |
| Akahira | 138 | 60 | 9–16 | 80.9 | 15.0 | 1.4 | 1.5 | 0.9 | 0.2 |
| Akahira | 170 | 97 | 9–16 | 76.1 | 14.2 | 5.2 | 1.9 | 1.0 | 1.5 |
| Shin-Yubari | — | — | 9–16 | — | — | — | — | — | — |
| Shin-Yubari | 120 | 43 | 9–16 | 11.8 | 33.9 | 35.3 | | 15.9 | |
| Shin-Yubari | 138 | 60 | 9–16 | 10.0 | 22.6 | 40.3 | 15.8 | 6.5 | 4.9 |
| Shin-Yubari | 170 | 97 | 9–16 | 22.7 | 31.9 | 25.4 | 10.1 | 5.1 | 4.8 |

For reference purposes, scanning-type electron microscope photographs of the surfaces of the starting coal and the treated coal (treated under the conditions indicated by point 23 in FIGS. 1 and 3) are shown in FIG. 2. FIG. 2-(1) shows the starting coal, and FIG. 2-(2) shows the treated coal. In the treated coal, a great number of large and small cracks are present, a pair of the treated coal crumbles while it is in the treating zone, and the treated coal is more finely divided when it is withdrawn from the treating zone.

The weight ratio of sulfur dioxide to the starting coal will now be described.

It is critical that sulfur dioxide must be charged in an amount sufficient to attain intimate contact between the starting coal and the sulfur dioxide. This amount differs depending on the type or configuration of the treatment apparatus. In general, sulfur dioxide is used at least in an amount sufficient to attain intimate contact in a sealed vessel at the batchwise treatment or in a larger amount, as necessary.

Figure 3:
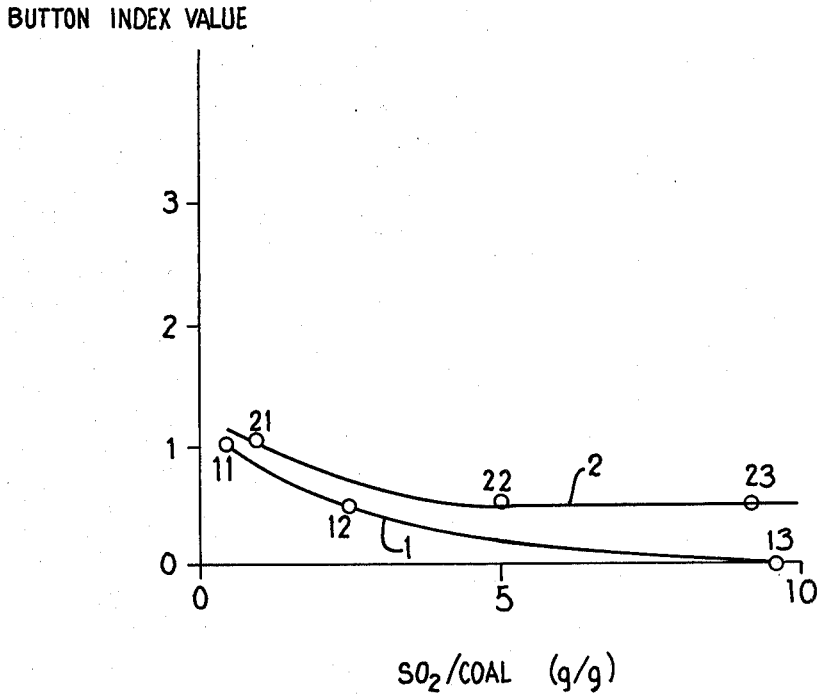
FIG. 3 is a graph of the experimental results showing the relation between the sulfur dioxide/coal weight ratio in the method of the present invention and the button index of the treated coal.

FIG. 3 illustrates the relation between the sulfur dioxide/coal weight ratio and the CSN index, which is observed when the batchwise treatment is carried out at 170° C. for 3 hours in a sealed vessel. Curve 1 indicates the results obtained in the case of Akahira coal and curve 2 indicates the results obtained in the case of Shin-Yubari coal. From these results, it is seen that at a treatment temperature of 170° C., even if the sulfur dioxide is used in an amount as low as 0.5 times the weight of the coal, the CSN index can be reduced below 1. Incidentally, the pressures at points 11, 12, 13, 21, 22 and 23 are 29, 46, 97, 30, 60 and 96 Kg/cm$^2$, respectively. It has also been found that when Akahira coal is treated at a temperature of 120° C. under a pressure of 10 Kg/cm$^2$ for 3 hours at a sulfur dioxide/coal weight ratio of 0.5, the CSN index of the treated coal is 2.0.

The pressure to be applied in the method of the present invention will readily be understood from the foregoing description. For example, a sufficient effect of reducing the caking property can be obtained in case of Akahira coal if the treatment is carried out under a pressure of 10 Kg/cm$^2$ at a temperature of 120° C. and a sulfur dioxide/coal weight ratio of 0.5.

It is critical that the contact should be conducted for a sufficient period of time. The contact time varies depending on the kind of the starting coal used, the particle size of the starting coal, the sulfur dioxide/starting coal weight ratio, the treatment temperature and the desired level of the CSN index of the final treated coal product.

Figure 4:
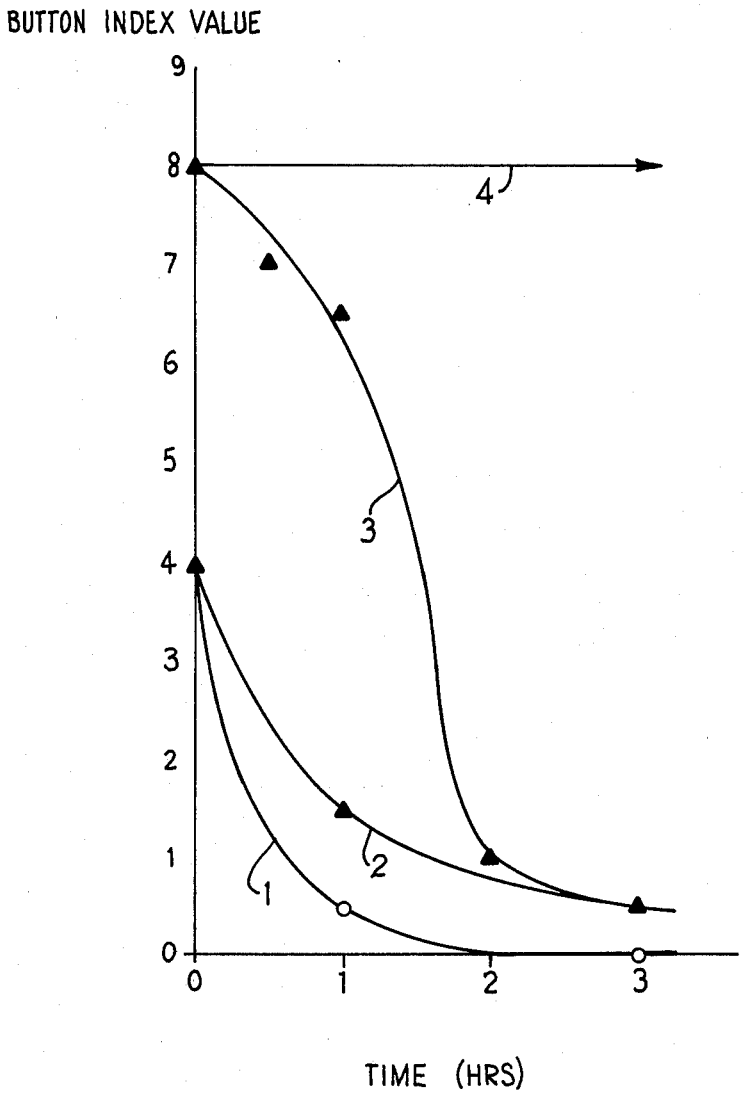
FIG. 4 is a graph of the experimental results showing the relation between the contact time in the method of the present invention and the button index of the treated coal.

FIG. 4 illustrates the relation between the contact time and the CSN index of the final treated coal product, which is observed when starting coal having a size of 9–16 mesh is treated with sulfur dioxide in an amount 9 times the amount of the starting coal, on a weight basis. Curves 1 and 2 show the results obtained by treating Akahira coal at 170° and 140° C., respectively, and curves 3 and 4 show results obtained by treating Shin-Yubari coal at 170° and 140° C., respectively. For example, in order to reduce the CSN index below 1.5 in Shin-Yubari coal, when sulfur dioxide is used in an amount 9 times the amount of coal, the contact time should be at least about 1 hour and 50 minutes at a treatment temperature of 170° C., and the above object cannot be attained at all at a temperature of 140° C. However, in case of Akahira coal, when sulfur dioxide is used in an amount 9 times the amount of coal, a contact time of about 1 hour is necessary at 140° C. and a contact time of 30 minutes is necessary at 170° C.

The substances extracted from the starting coal by the treatment of the present invention and the amounts thereof will now be described.

When the treatment is carried out under the conditions of the present invention, the amount of extracted substances is about 1 to about 3 wt. %, and the average molecular weight of the extracted substances, based on the starting coal, is about 300.

At points 13 and 23 in FIG. 1, the amounts of the extracted substances are 1.36% and 2.17%, respectively.

If necessary, after the treated coal has been separated from the sulfur dioxide, the extracted substances can be separated by using an organic solvent such as diethyl ether or benzene, an organic halogen-containing solvent such as chloroform or a mixture thereof.

The chemical analysis values of the starting coal and the treated coal are shown in Table 3.

TABLE 3

| Coal | Treatment Conditions | Elementary Analysis Values (%) C | H | N | S | O |
|---|---|---|---|---|---|---|
| starting Akahira coal | — | 82.3 | 5.9 | 2.3 | 0.3 | 9.2 |
| treated coal | 170° C., 97 Kg/cm$^2$, 3 hours, sulfur dioxide/starting coal weight ratio of 9 | 1.0 | 4.9 | 1.0 | 6.4 | 16.7 |
| starting Shin-Yubari coal | — | 86.1 | 6.1 | 2.0 | 0.3 | 5.5 |
| treated coal | 170° C., 97 Kg/cm$^2$, 3 hours, sulfur dioxide/starting coal weight ratio of 9 | 78.2 | 5.2 | 0.8 | 5.8 | 10.0 |

As will be apparent from the foregoing illustration, the caking property of coal can be reduced by the treatment method of the present invention, and the pulverizability can be improved.

The particle size of the starting coal is not critical. Normally the particle size of the coal will be less than about 10 mm. In most cases, as the particle size of the coal is made smaller, the treatment time can be made shorter and/or treatment conditions of temperature, pressure and/or $SO_2$ concentration can be made more gentle.

The treatment can be performed with either liquid or gaseous $SO_2$ or part liquid $SO_2$ and part gaseous $SO_2$. It is advantageous to carry out the treatment in a closed vessel wherein the pressure is the autogeneous pressure corresponding to the absolute saturated vapor pressure of sulfur dioxide at the treatment temperature used.

The duration of the treatment time can be reduced by using a treatment temperature above the critical temperature of sulfur dioxide (157.8° C.). The use of a treatment temperature above 157.8° C. is especially desirable when the starting coal has a high CSN index of about 7 or higher. The maximum treatment temperature is not critical, but to minimize expense and damage to equipment, it is preferred that the maximum temperature does not exceed about 200° C.

The maximum weight ratio of $SO_2$/coal is not critical, but to minimize costs, it is preferred to use a maximum weight ratio of $SO_2$/coal of about 10/1.0 because the results are not significantly improved by using higher ratios.

The embodiments of the invention in which an exclusive property or privilege is claimed are defined as follows:

1. A method for treating coal to reduce the caking property and to increase the friability thereof, which comprises the steps of: intimately contacting coal particles with sulfur dioxide, at a temperature of at least from 120° C. to 200° C., at a pressure of at least 10 Kg/cm$^2$, at a weight ratio of $SO_2$/coal equal to or greater than 0.5, for a period of time effective to reduce the caking property of the coal to the desired value; and then separating the coal particles from the sulfur dioxide.

2. A method according to claim 1 in which the pressure is the absolute saturated vapor pressure of sulfur dioxide at said temperature used and the weight ratio of $SO_2$/coal is from 0.5/1 to 10/1.

3. A method for treating coal to reduce the caking property and to increase the friability thereof, which comprises the steps of: in a closed vessel, mixing and intimately contacting coal particles with liquid or gaseous sulfur dioxide, at a temperature of from 120° to 200° C., at an autogenous pressure corresponding to the absolute saturated vapor pressure of sulfur dioxide at said temperature, wherein the weight ratio of $SO_2$/coal is from 0.5/1 to 10/1, until the CSN index value of the coal particles is reduced to about 1.5 or lower; and then separating the coal particles from the sulfur dioxide.

4. A method as claimed in claim 3 in which the higher is the CSN index value of the starting coal particles, the higher is the temperature used in the treatment, the temperature being sufficient to reduce the CSN index value of the coal particles to about 1.5 or lower.

5. A method as claimed in claim 1, in which the temperature is at least 157.8° C. so that the sulfur dioxide is in the gas state.

6. A method according to claim 1 or claim 3 in which the sulfur dioxide is in the gaseous state.

7. A method according to claim 1 or claim 3 in which the temperature is at least 157.8° C.

* * * * *

UNITED STATES PATENT AND TRADEMARK OFFICE

CERTIFICATE OF CORRECTION

PATENT NO. : 4 278 442

DATED : July 14, 1981

INVENTOR(S) : Minoru Matsuda et al

It is certified that error appears in the above—identified patent and that said Letters Patent is hereby corrected as shown below:

On the Title Page, Item [76] "Kitamemechi" should read --- Kitamemachi ---.

Column 6, line 14; delete "at least".

Column 6, line 40; change "claim 1" to ---claim 3---.

Signed and Sealed this

First Day of June 1982

[SEAL]

Attest:

GERALD J. MOSSINGHOFF

Attesting Officer

Commissioner of Patents and Trademarks